US005135390A

United States Patent [19]

Rodriguez

[11] Patent Number: 5,135,390

[45] Date of Patent: Aug. 4, 1992

[54] FLAMBEAU TORCH

[76] Inventor: Alfred L. Rodriguez, 61280 King Arms Dr., Lacombe, La. 70445

[21] Appl. No.: 646,064

[22] Filed: Jan. 25, 1991

[51] Int. Cl.[5] ..... F23D 14/28

[52] U.S. Cl. ..... 431/344; 431/345; 431/353

[58] Field of Search ..... 431/344, 345, 353

[56] References Cited

U.S. PATENT DOCUMENTS

| | | | |
|---|---|---|---|
| 657,036 | 8/1900 | Snowden . | |
| 739,221 | 9/1903 | Reinlein . | |
| 909,069 | 1/1909 | Eason . | |
| 1,012,355 | 12/1911 | Herder | 431/345 |
| 1,214,880 | 2/1917 | Becher | 431/345 |
| 1,340,012 | 5/1920 | Cave et al. . | |
| 3,029,807 | 4/1962 | Webster | 126/271.2 |
| 3,295,509 | 1/1967 | Harvey | 126/25 |
| 3,580,700 | 5/1971 | Hinckley | 431/353 |
| 3,589,312 | 6/1971 | Cooper | 110/1 F |
| 3,605,653 | 9/1971 | Donnell | 110/1 F |
| 4,779,608 | 10/1988 | Smith | 126/127 |
| 4,891,005 | 1/1990 | Carter | 431/343 |

*Primary Examiner*—Carroll B. Dority
*Attorney, Agent, or Firm*—C. Emmett Pugh

[57] ABSTRACT

A portable, flambeau torch utilizing liquid propane gas, butane, or the like fuel in contrast to the fluid kerosene or "white gas" of traditional flambeau devices. A backpack support (1) for the user or operator holds the gas containment tank (6) and first regulator stage (10). A torch frame (18–19/20–22) carrying a multiple number of burners (23*a–d*) is connected to the tank by means of a quick disconnect (12) hose (11) and an internal passageway formed by the hollow, closed ended, tubular members making up the torch frame. A hand manipulated, quick release, kill switch (14) is held down by the operator to allow the gas to continuously flow to the burners during use (see FIG. 3). Concentric cylindrical members (23 and 25 ) form combustion chambers (32) for the burners.

7 Claims, 2 Drawing Sheets

ON
OFF

FLAMBEAU TORCH

BACKGROUND OF INVENTION

1. Field of Invention

The present invention relates to the portable, ornamental torches, and more particularly to a new and novel "flambeau" system used, for example, in parades and the like, typically for nighttime illumination.

The present invention teaches a portable, improved flambeau system utilizing, for example, liquid propane gas, butane, or the like as opposed to the fluid kerosene or "white gas" of traditional "flambeaus". The present invention teaches in its preferred embodiment the utilization of a backpack support for the wearer for holding the gas containment tank and a first regulator stage, an enhanced torch frame design, quick disconnect hose capability for conveying the gas to the burners, a quick release safety valve capability, a torch frame with built-in, internal gas conveying capability to the burners, and a specially designed, novel burner system optimizing the flame of the present system.

2. Prior Art and General Background

The flambeau is a flaming, ornamental torch which is carried by a bearer, normally during processions, parades and the like. While useful prior to the days of electricity, the flambeau's use today is very limited, and it's only known use in the United States today is during the Mardi Gras holidays in New Orleans, where its continued use has been a tradition for well over one hundred years.

However, the continued use of the flambeau has been called into serious question by the local government, insurance, and Mardi Gras associations due to the inherent dangers associated with the traditional flambeau.

The traditional flambeau, as used in Mardi Gras parades, comprises a torch frame in the form of a cross, with a kerosene or "white gas" container located at the top of the vertical member of the cross, a conduit for conveying the volatile fluid to the burners, and a number of gravity fed burners on the horizontal cross member. This arrangement, believed designed several decades ago, presents several safety concerns.

The burning kerosene often drips continuously, forming a severe fire and burn hazard to the floats, operator, or spectators. Further, the kerosene container, mounted above the flames, not only presents an awkward weight distribution problem, but also is a fire hazard, as any rupture of the container could empty the contents upon the operator, severely burning him. Further, the awkward weight distribution is such that if the operator were to lose his grip, the stand would fall to the ground, causing the container to rupture and its contents to ignite.

Consequently, there has been a great, long standing need for a safe, alternative system to the flambeaus traditionally used. The ideal system would provide a clean, "no-drip" flame with adequate safeguards to prevent ignition of the fuel container, while providing a traditional-looking ornamental torch which would be portable and cost effective in its operation. As may be determined from the discussion below, the prior art has failed to provide such a system.

A list of prior patents which may be of interest is presented below:

| Patent No. | Petentee(s) | Issue Date |
|---|---|---|
| 657,036 | L. W. Snowden | 08/28/1900 |
| 739,221 | F. Reinlein | 09/15/1903 |
| 909,069 | H. H. Eason | 01/05/1909 |
| 1,340,012 | Cave & Anderson | 05/11/1920 |
| 3,029,807 | M. E. Webster | 04/17/1962 |
| 3,295,509 | R. E. Harvey | 01/03/1967 |
| 3,589,312 | M. V. Cooper | 06/29/1971 |
| 3,605,653 | F. Donnell | 09/20/1971 |
| 4,779,608 | T. R. Smith | 10/25/1988 |
| 4,891,005 | R. E. Carter | 01/02/1990 |

As can be determined by a review of the above, there apparently exists no prior art teaching any portable, ornamental gas torches, much less of the type contemplated in the present invention.

U.S. Pat. Nos. 657,036, 739,221, and 1,340,012, issued 1900, 1903, and 1920 respectively, all teach flame conveying apparatus, although not for lighting purposes, which are carried upon the back. These early torches are clearly distinguishable both in function and construction from the present invention.

The other patents cited teach burner jet configurations and are likewise clearly distinguishable from the present invention, and are only cited for general information purposes.

The traditional parade flambeau of old was apparently unpatented and is still in use today. The traditional flambeau comprises a parade torch having a generally displaced vertical handle member and a horizontal burner member, the two joined to form a cross. The fuel used in this torch has generally been kerosene or "white gas", contained in a container affixed to the portion of the vertical handle member above the horizontal burner member, so that the fuel will be gravity fed to the burners.

The burners on the horizontal member, fed via a hose from the fuel container, generally were a drip-type liquid torch burner, as discussed earlier.

GENERAL, SUMMARY DISCUSSION OF THE INVENTION

The present invention overcomes these prior art problems by providing a system which is highly reliable, relatively economical and very cost effective.

Unlike the prior art methods disclosed above, the present invention provides a cool, drip-free flame combined with safer, controlled, remote fuel containment. Further, the present invention provides a more comfortable, less strenuous system for carrying the fuel container, lessening the chances of injury.

The present invention teaches in its preferred embodiment an improved flambeau system utilizing a clean burning compressed pressurized fluid such as liquid propane or the like in the form of a backpack/containment system, regulation means to reduce the fuel compression to an optimum rate for mixing/combustion, a torch frame designed with conduit means built in for safety and reliability, and a specially designed torch burner system including a mixing chamber for optimum combustion efficiency and light or illumination output.

The present invention as designed provides an efficient, safe, cost effective flambeau system which is usable under today's safety and health standards.

It is thus an object of the present invention to provide an improved flambeau system utilizing remote fuel containment and a drip-free, clean burning fuel.

It is a further object of the present invention to provide an improved flambeau system which is less burdensome to carry and which is safer to operate without a sacrifice of the quality of the ornamental flame.

It is a still further object of the present invention to provide an flambeau system which includes an improved burner design which provides a more efficient burning, yet with an improved quality, ornamental flame.

Lastly, it is an object of the present invention to provide a flambeau system which is easily adjustable, both with regard to the user and the height and color of the flame, and which is safer to operate than the prior art devices.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENT(S)

Figures 1, 1A, 2:
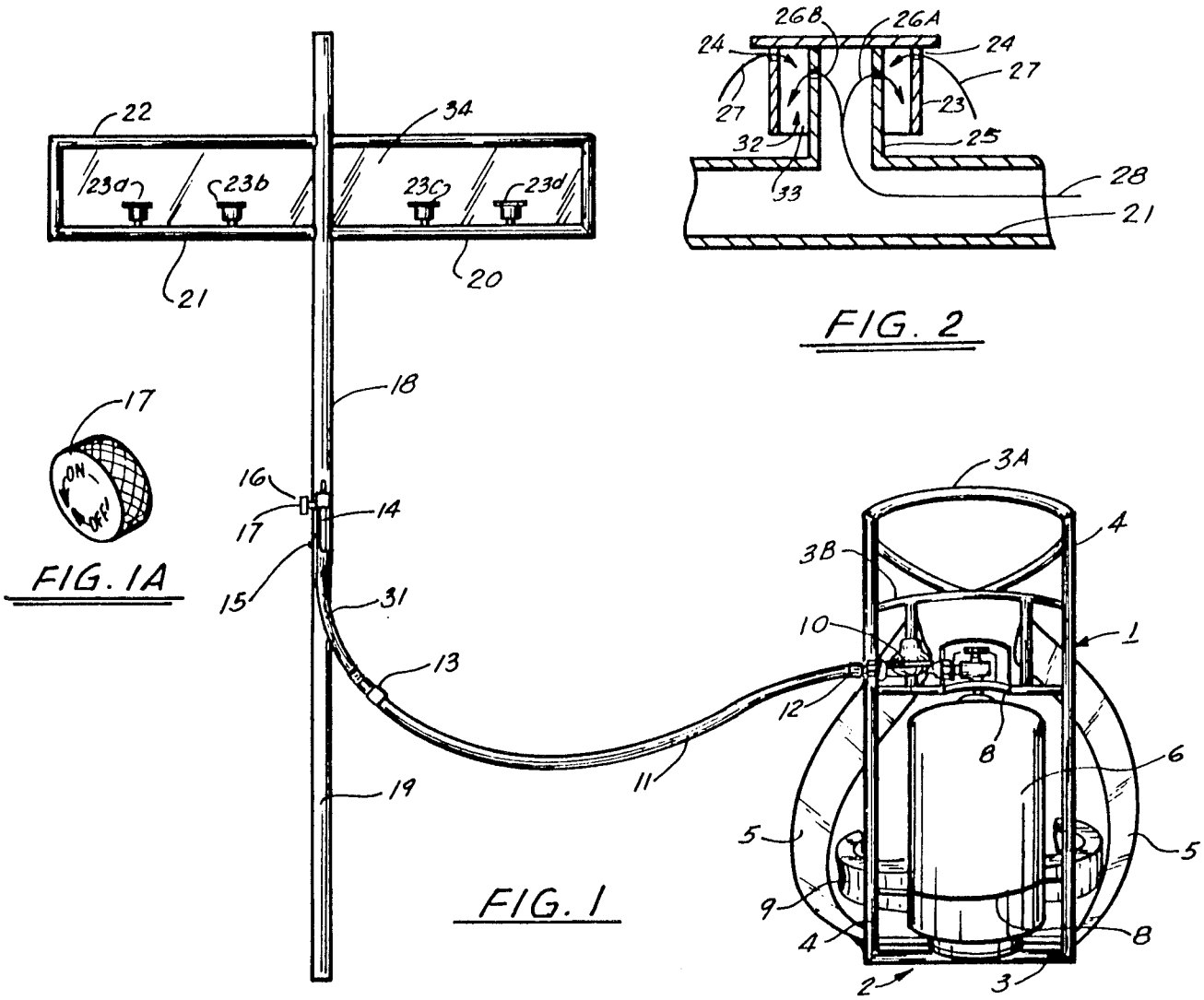
FIG. 1 is a rear view of the preferred exemplary embodiment of the flambeau of the present invention.
FIG. 1A is a close-up, perspective view of the actuation or control knob for the pilot light/kill valve of FIG. 1.
FIG. 2 is a cross sectional, detailed view of the burner of the flambeau of FIG. 1.

As can be seen in FIG. 1, the flambeau system of the preferred, exemplary embodiment of the present invention includes a backpack 1 having a tank support frame 2 comprised of horizontal 3 and vertical 4 support members. The upper, horizontal frame members 3A, 3B are preferably curved to ergometrically communicate with the back of the user.

A compressed or pressurized gas or liquid tank 6 is affixed to the frame 2 via tank securing straps 8.

Padded shoulder straps 5 and a partially encircling, padded waist band 9 are also provided for facilitating comfortable use and carrying of the frame 1 by the operator on the operator's body. The shoulder straps 5 could be made to be adjustable, if so desired.

Figure 3:
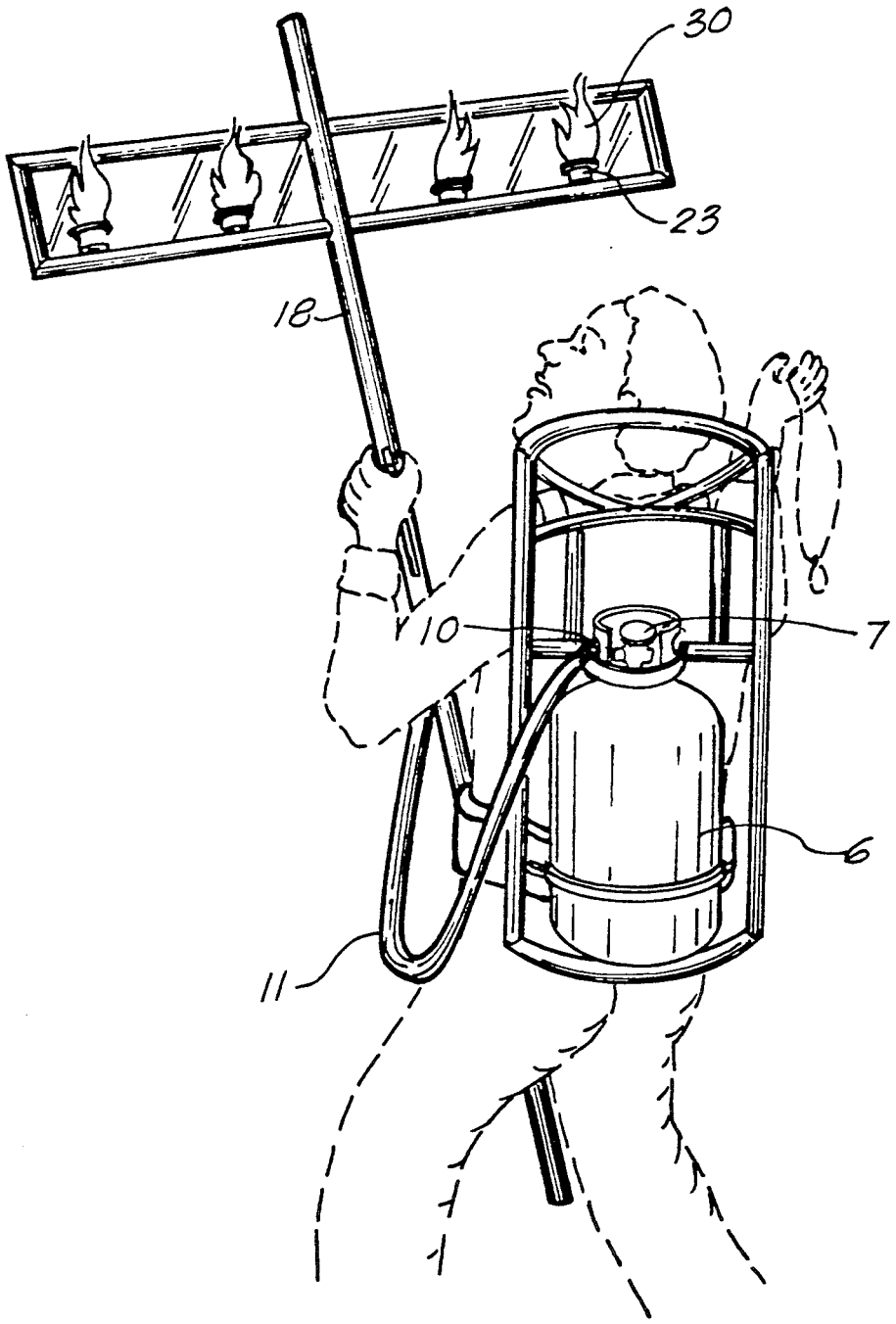
FIG. 3 is an isometric view of the flambeau of FIG. 1 in use.

The frame 1 could also be used to support decorative or festive items and be covered over with decorative materials and/or signs and the like (as generally illustrated in dashed or phantom lines in FIG. 3).

The pressurized fluid tank 6 as taught in the preferred embodiment is a ten pound, liquid propane gas type, although butane, natural gas and other fuels (and other size tanks) could also be used.

Threadingly affixed to the tank 6 is the main shut-off valve 7 to the system, which is in turn affixed to the regulator 10 for reducing the tank pressure to a usable amount for a flaming torch. Affixed to the regulator 10 via a quick disconnect connector 12 is a main hose section 11, which in the exemplary embodiment has a length of an exemplary three (3') feet, and is comprised of a half (0.5") inch flame resistant safety hose.

The main hose section 1 is affixed to a minor hose section 31 via a swivel/quick disconnect 13, so as to prevent entanglement or "bunching up" of the hose during operation. The minor hose section 31 is affixed to a manual, spring biased, quick release, kill switch 14, which is utilized by the operator when the system is working. This kill switch 14 may include or may be in communication with a separate pilot light/kill valve 16, which includes a knurled operation knob 17 for adjusting the pilot flow of the system. Manual quick kill switch 14 and the pilot light/kill valve 16 are affixed to the torch frame/conduit 18 with the actuation lever positioned parallel to the longitudinal member 18 so that it can be concurrently held down while the operator grasps the lower portion 19 of the member 18.

As taught in the exemplary embodiment of the present invention, the torch frame/conduit 18 is preferably fabricated of hollow square (or alternatively circular) aluminum one inch (1"), one-eighth (⅛") inch thick aluminum tubing or the like, with the ends sealed or blocked. The exemplary embodiment of the present invention has a general configuration of a cross, with a single vertical member 18/19, a main horizontal or laterally extended member 21, and a minor horizontal or laterally extended member 22.

The preferred embodiment of the present invention utilizes the hollow area inside the frame members 18 and 21 from the location of the pilot light/kill valve 16 to the burners to act as an internal passageway or conduit for the fuel gas, eliminating the need for exterior, supplemental tubing, hosing or the like. To achieve this the frame members 18 and 21 are built or fabricated so that their hollow interiors intercommunicate or interconnect.

The torch frame/conduit of the present invention includes a lower handle area 19, which is grasped by the user in operation, and an upper torch area 20, which is located an exemplary four specially designed burners 23*a*, 23*b*, 23*c*, 23*d*. The minor horizontal support 22, located above and parallel to the main horizontal support 20, may be used for supporting reflectors and the like. The torch frame/conduit may also contain a burst plate or bleeder valve 15 for venting excess gas in the event of over-pressurization or overheating.

FIG. 2 illustrates an enlarged, cross sectional view of the burners of FIG. 1, wherein each torch burner 23(*a–d*) includes an inner gas conduit 25 and a concentric outer wall 29, forming a combustion chamber 32 therebetween. The upper portion of the inner gas conduit 25 has apertures 26A, 26B formed therein for allowing while the outer wall 29 has vents 24 formed thereon for the intake of air into the combustion chamber 32.

As further shown in FIG. 2, the gas (note direction arrows 28) is conveyed through the hollow horizontal frame member 21 to apertures 26A, 26B, where it is fed into the combustion chamber 32. Fresh air (note direction arrows 27) is vented into the chamber via vents 24 to form an optimal mixture with the gas for burning with a bright, cool flame emanating from the circular configured mouth opening 33 at the bottom of the combustion chamber 32.

FIG. 3 illustrates the use of the preferred embodiment of the present invention. The backpack 1 is secured about the operator using the shoulder straps 5 and the waist band 9, comfortably supporting the tank 6 on the operator's back, while the operator grasps, carries and manipulates the lower portion 19 of the torch frame 18, with the upper portion, that is the portion of the frame which carries the horizontal member 21 with its burners 23, above the head of the operator. In order for the burners 23 to be carried above the operator's head, the vertical or longitudinally extended member 18/19 should have a minimum length of about three (3') feet.

As can be seen in FIG. 3, the burners 23 are sufficiently spaced from one another to produce individualized, separated flames which do not over-lap with one another, with preferably at least a pair of burners located on each side of the vertical member 18. The length of lateral members 21 and 22 should be at least a foot (1') on either side of the vertical member 18.

In operation, the gas escapes under relatively high pressure from tank 6 when the main valve 7 is opened, and the escaped gas then is regulated to a lower pressure via the regulator 10 prior to reaching the hose 11 The gas is then conveyed to the manual kill switch 14, which is held down into an "open" position by the operator by the operator manually pushing the spring biased lever against the frame 18, and then passing into the conduit passageway formed within the frame 18 to burners *23a–d*, where the gas is mixed with air and ignited into individual flames 30. The burners *23a–d* are sufficiently spaced, for example, by about six (6") inches, so that the burners generate clearly separate, individual, spaced flames.

When the operator releases the handle of the manual kill switch 14, gas flow is cut off to the burners *23a–d* and the flames are thereby extinguishable. Thereafter, when desired, the handle on the kill switch is again depressed and the flames again ignited by suitable means. If desired, automatic, semi-automatic or manual flame ignition or sparking means could be included and suitably located on the flambeaux structure.

It is noted that, in addition to the "cross" configuration illustrated in the preferred embodiment, the torch can effectively operate in other configurations, such as a square, triangle, circle or the like, or combination thereof, depending upon the application and desired aesthetics. Regardless of the configuration, they typically each will include a longitudinally extended frame member and at least one laterally extended member extending to either side of the longitudinally extended member.

The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A portable, operator-carried, self-contained flambeau type ornamental torch utilizing a pressurized, flammable fluid as a flammable gas source, comprising:

support means for supporting a tank of pressurized, flammable fluid and a regulator associated therewith upon the operator's body, a torch frame associated with said support means;

an interconnecting hose associated with said support means and said torch frame having terminal ends at least indirectly connectable to said torch frame and to the tank on said support means and capable of conveying flammable gas from the tank to said torch frame; and at least one burner affixed to said torch frame, said burner receiving compressed gas from said tank through said hose, said burner further comprising an inner gas conduit and an outer wall, said inner gas conduit and said outer wall being configured to form a combustion chamber therebetween, said inner gas conduit having an upper end, said inner gas conduit having at least one aperture formed in said upper end for allowing the escape of gas therethrough into said combustion chamber.

2. The portable, self contained flambeau of claim 1, wherein:

said outer wall of said burner further includes at least one vent for venting fresh air into said combustion chamber.

3. The portable, self contained flambeau of claim 1, wherein:

said inner gas conduit and said outer wall of said burner are cylindrical in configuration and concentric with one another.

4. The portable, self contained flambeau of claim 1, wherein:

said torch frame is formed in the shape of a cross having a vertical member and at least one horizontal member; and wherein there is further included:

a multiple number of said burners located on said horizontal member.

5. The portable, self contained flambeau of claim 4, wherein:

said horizontal and vertical members are hollow, forming an internal, interconnected passageway in said torch frame, and said horizontal and said vertical members have terminal ends, which are blocked closing off said passageway, the flammable gas being conveyed from said hose to said burners via said internal passageway formed in said torch frame.

6. A portable, operator-carried, self-contained flambeau type ornamental torch utilizing pressurized, flammable fluid as a flammable gas source, comprising:

backpack support means for supporting a tank of pressurized, flammable fluid and a regulator associated therewith upon the operator's back, said support means including a rigid frame for carrying the tank and shoulder straps connected to said support frame for supporting said rigid frame over the shoulders of the operator;

a torch frame associated with said support means formed of a longitudinally extended member with a minimum length of about three feet with an upper portion and a lower portion and at least one laterally extended member attached to said upper portion of said longitudinally extended member and extending laterally out past the sides of said longitudinally extended member a minimum distance of about a foot, said lower portion being gripable by the operator to manipulate said torch frame as the operator caries it with it extending upwardly with said laterally extended member being positioned above the operator's head, said laterally extended and longitudinal members being hollow and interconnected, forming an interconnected, internal passageway in said torch frame, said laterally extended and said longitudinally extended members have terminal ends, which are blocked closing off said passageway;

an interconnecting hose associated with said support means and said torch frame having terminal ends at least indirectly connectable to said torch frame and to the tank on said support means when said torch frame is carried in the hands of the operator and said support frame is carried on the body of the operator, said hose capable of conveying flammable gas from the tank to said torch frame to be burned; and at least four burners affixed to said laterally extended member of said torch frame, a pair on each side of said longitudinally extended member, with each said pair being sufficiently separated from each other to generate clearly separated, individual, spaced flames when the flammable gas is ignited and burned at said burners, with each said burner receiving flammable gas from said tank through said hose, the flammable gas being conveyed from said hose to said burners via said internal passageway formed in said torch frame, said burners further comprising an inner gas conduit and an outer wall, said inner gas conduit and outer wall being configured to form a combustion chamber therebetween, said inner gas conduit having an upper end, said inner gas conduit having at least one aperture formed in said upper end for allowing the escape of gas therethrough into said combustion chamber.

7. The portable, self contained flambeau of claim 6, wherein there is further included:

a quick kill valve i line with said hose and said burners and located on said lower portion of said longitudinally extended member, said quick kill valve including an actuation lever which is spring biased in a closed disposition and extends along the extended length of said longitudinally extended member, said lever being located on said longitudinally extended member and of a length to be gripable and holdable in an open disposition in the hand of the operator as the operator holds the lower portion of said longitudinally extended member to manipulate and carry said torch frame.

* * * * *